US011274000B2

(12) United States Patent
Nishimura

(10) Patent No.: US 11,274,000 B2
(45) Date of Patent: Mar. 15, 2022

(54) SHEET FEEDING DEVICE AND IMAGE FORMING APPARATUS

(71) Applicant: KYOCERA Document Solutions Inc., Osaka (JP)

(72) Inventor: Takuya Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 164 days.

(21) Appl. No.: 16/674,369

(22) Filed: Nov. 5, 2019

(65) Prior Publication Data

US 2020/0156888 A1 May 21, 2020

(30) Foreign Application Priority Data

Nov. 16, 2018 (JP) ..... JP2018-215686

(51) Int. Cl.
*B65H 1/26* (2006.01)

(52) U.S. Cl.
CPC ..... *B65H 1/266* (2013.01); *B65H 2402/32* (2013.01); *B65H 2405/32* (2013.01)

(58) Field of Classification Search
CPC . B65H 1/04; B65H 1/26; B65H 1/266; B65H 2402/32; B65H 2405/32; B65H 2405/35; G03G 2221/1684; A47B 88/437; A47B 88/483; A47B 88/487
See application file for complete search history.

(56) References Cited

U.S. PATENT DOCUMENTS

| | | | | |
|---|---|---|---|---|
| 4,595,247 | A * | 6/1986 | Zank | A47B 88/487 312/334.19 |
| 2009/0166956 | A1* | 7/2009 | Kajiyama | B65H 1/266 271/164 |
| 2013/0032996 | A1* | 2/2013 | Kubota | B65H 1/266 271/264 |
| 2014/0021680 | A1* | 1/2014 | Hamasaki | B65H 1/00 271/147 |
| 2018/0203395 | A1* | 7/2018 | Kang | G03G 15/6508 |
| 2019/0233227 | A1* | 8/2019 | Sato | G03G 15/6502 |

FOREIGN PATENT DOCUMENTS

JP 2014111494 A 6/2014

* cited by examiner

*Primary Examiner* — Prasad V Gokhale
(74) *Attorney, Agent, or Firm* — Studebaker & Brackett PC

(57) ABSTRACT

A sheet feeding device includes a housing, a sheet storage cassette, a slide rail and an upper contact member. The housing has a pair of inner walls facing each other. The sheet storage cassette is attached between the inner walls in an insertable and drawable manner along a first direction. The sheet storage cassette has a pair of wall parts facing the pair of inner walls. The slide rail includes an outer rail and an inner rail. The outer rail extends along the first direction on the inner wall and the inner rail extends along the first direction on the wall part. The inner rail is supported by the outer rail in a movable manner. The upper contact member is provided on the wall part and moves on an upper face of the outer rail when the sheet storage cassette is inserted and drawn with respect to the housing.

7 Claims, 6 Drawing Sheets

SHEET FEEDING DEVICE AND IMAGE FORMING APPARATUS

INCORPORATION BY REFERENCE

This application is based on and claims the benefit of priority from Japanese patent application No. 2018-215686 filed on Nov. 16, 2018, which is incorporated by reference in its entirety.

BACKGROUND

The present disclosure relates to a sheet feeding device which feeds a sheet and an image forming apparatus including the sheet feeding device.

An image forming apparatus provided with a slide rail which supports a sheet storage cassette which stores a sheet is known. The slide rail includes an outer rail mounted to a housing of the image forming apparatus and an inner rail mounted to the sheet storage cassette, and the outer rail supports the inner rail in a slidable manner.

As for the above configuration, a positioning of the sheet storage cassette with respect to the slide rail is discussed. For example, the inner rail is provided with a positioning pin and the sheet storage cassette is provided with an engagement hole. The engagement hole is engaged with the positioning pin to position the sheet storage cassette with respect to the slide rail.

However, in the above configuration, because the pin is applied with a load of the sheet storage cassette containing the sheet, the inner rail is deformed to be fallen inside. Then, a sliding resistance of the slide rail is increased, and a large force is thus required to insert and draw the sheet storage cassette. Especially, in a case of an image forming apparatus provided with an automatic retracting device to retract the sheet storage cassette into the housing, it becomes difficult to retract the sheet storage cassette smoothly owing to the increase of the sliding resistance. Furthermore, if the inner rail is deformed, the positioning accuracy of the sheet storage cassette is decreased and it becomes difficult to feed the sheet smoothly.

SUMMARY

In accordance with an aspect of the present disclosure, a sheet feeding device includes a housing, a sheet storage cassette, a slide rail and an upper contact member. The housing has a pair of inner walls facing each other. The sheet storage cassette is attached between the inner walls in an insertable and drawable manner along a first direction. The sheet storage cassette has a pair of wall parts facing the pair of inner walls. The slide rail includes an outer rail and an inner rail. The outer rail extends along the first direction on the inner wall and the inner rail extends along the first direction on the wall part. The inner rail is supported by the outer rail in a movable manner. The upper contact member is provided on each of the wall parts and moves on an upper face of the outer rail when the sheet storage cassette is inserted and drawn with respect to the housing.

In accordance with an aspect of the present disclosure, an image forming apparatus includes the sheet feeding device and an image forming portion which forms a toner image on sheet fed from the sheet feeding device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus and a sheet feeding device will be described with reference to the drawings.

Figure 1:
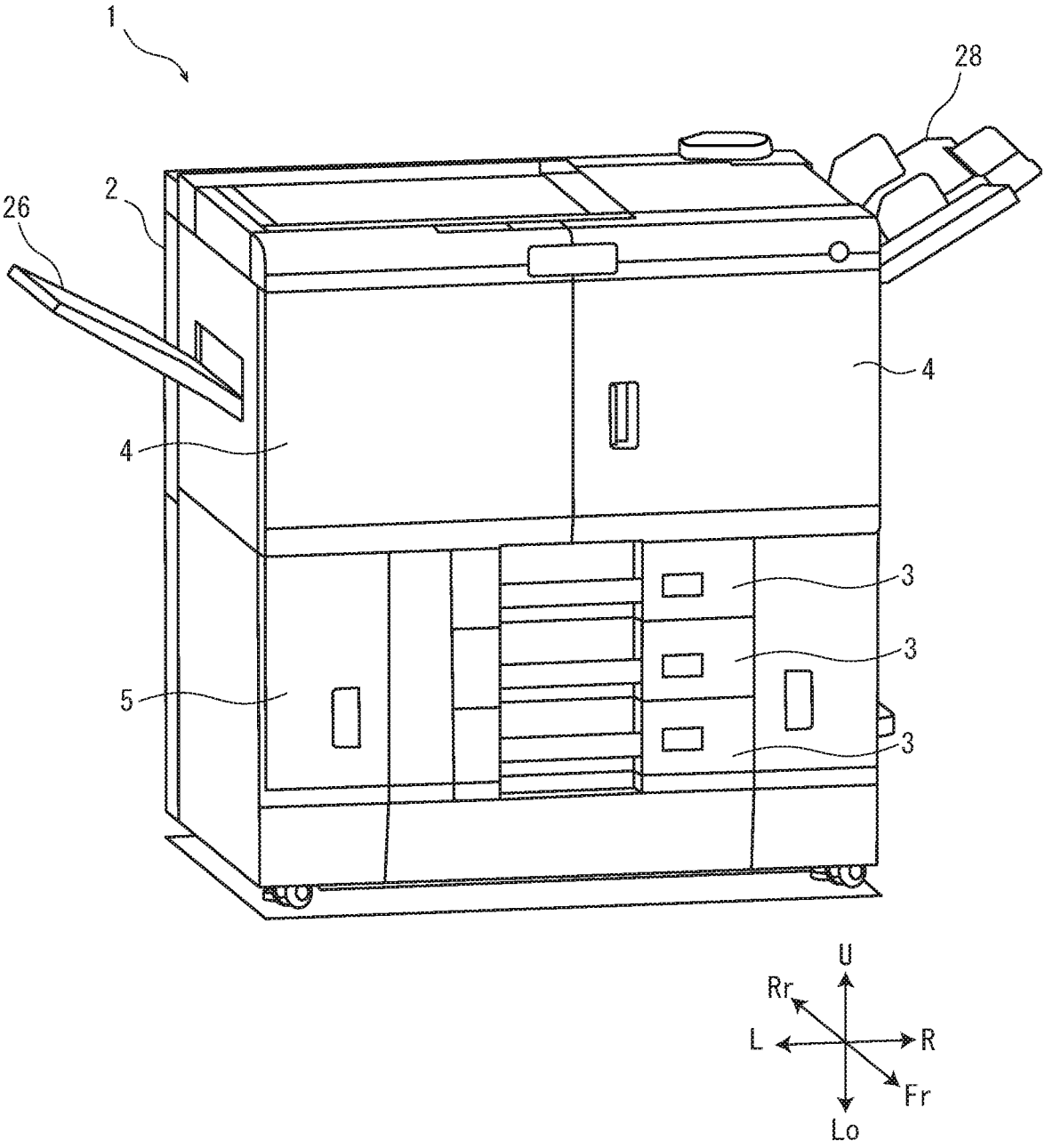
FIG. 1 is a perspective view showing an appearance of a printer according to one embodiment of the present disclosure.
Figure 2:
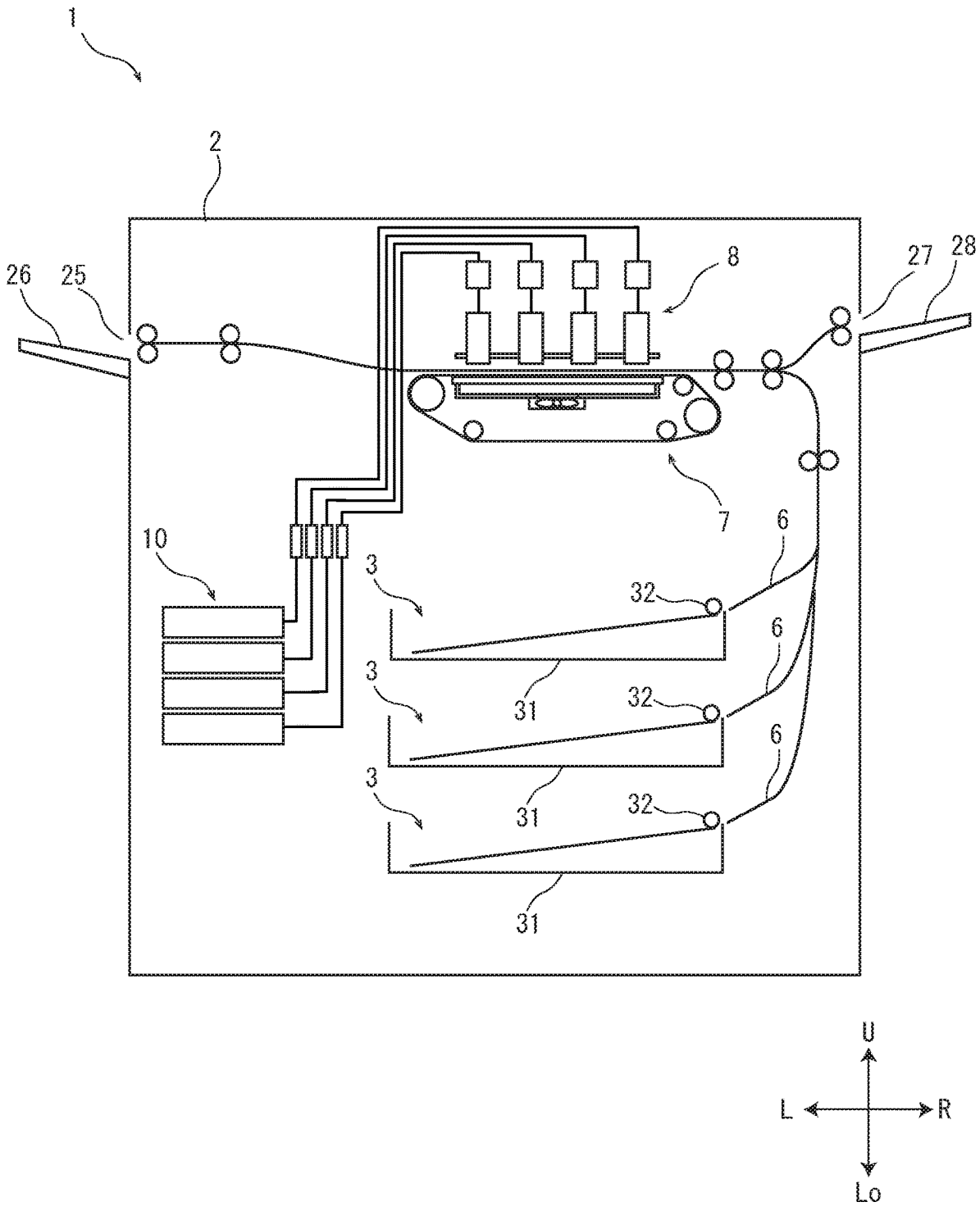
FIG. 2 is a front view schematically showing an inner structure of the printer according to the embodiment of the present disclosure.

Firstly, with reference to FIG. 1 and FIG. 2, an entire structure of a printer 1 (an example of an image forming apparatus) will be described. FIG. 1 is a perspective view showing an appearance of the printer 1. FIG. 2 is a front view schematically showing an inner structure of the printer 1. In the following description, a front side on a paper surface in FIG. 1 is defined as a front side of the printer 1. In each figure, U, Lo, L, R, Fr and Rr respectively show an upper, a lower, a left, a right, a front and a rear.

The printer 1 includes a box-like shaped housing 2. In the lower portion of the housing 2, a plurality of sheet feeding devices 3 is provided. The sheet feeding device 3 includes a sheet storage cassette 31 in which a sheet is stored, and a feeding roller 32 which feeds the sheet from each sheet storage cassettes 31 to a conveyance path 6. In the lower portion of the housing 2, a cassette storage part whose front face is opened is formed. The cassette storage part has a pair of inner walls 2*a* facing each other in the left-and-right direction (refer to FIG. 4). In the upper portion of the housing 2, a plurality of recording heads 8 (an example of an image forming portion) which respectively eject inks of black, cyan, magenta and yellow is provided. To the left lower portion of the housing 2, a plurality of ink containers 10 is attached. Between the ink containers 10 and the respective recording heads 8, individual ink supplying paths are formed for each color of the inks.

On the upper portion of the left side face of the housing 2, a discharge port 25 is provided, and a discharge tray 26 is provided below the discharge port 25. The conveyance path 6 is formed from the sheet feeding devices 3 to the discharge port 25 via the recording heads 8. On the upper portion of the right side face of the housing 2, a manual sheet feeding port 27 is provided, and a manual sheet feeding tray 28 is provided below the manual sheet feeding port 27. A sheet conveyance unit 7 is disposed at a position facing the recording heads 8 via the conveyance path 6. The sheet conveyance unit 7 includes an endless belt wound around a drive roller, a driven roller and a tension roller.

Next, an image forming operation of the printer 1 will be described. When the printer 1 receives an image forming job from an external computer, the sheet having a size designated by the image forming job is fed by the sheet feeding device 3 or the manual sheet feeding tray 28 to the conveyance path 6. The recording heads 8 are supplied with the inks from the respective ink containers 10, and eject the inks on the sheet based on the image forming job to form an image on the sheet. The sheet having the image is discharged through the discharge port 25 on the discharge tray 26.

Figure 3A:
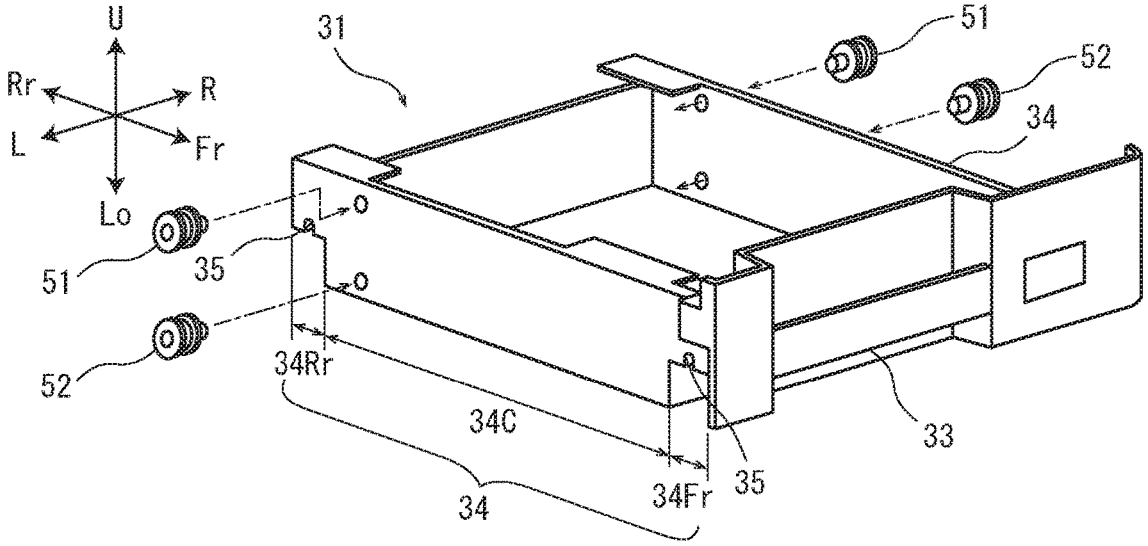
FIG. 3A is a perspective view showing a sheet storage cassette according to the embodiment of the present disclosure.
Figure 3B:
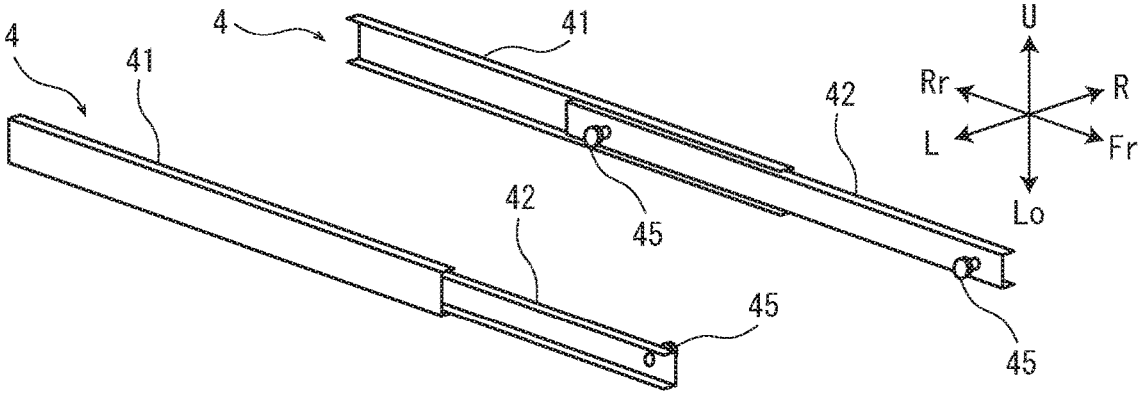
FIG. 3B is a perspective view showing a slide rail according to the embodiment of the present disclosure.
Figure 3C:
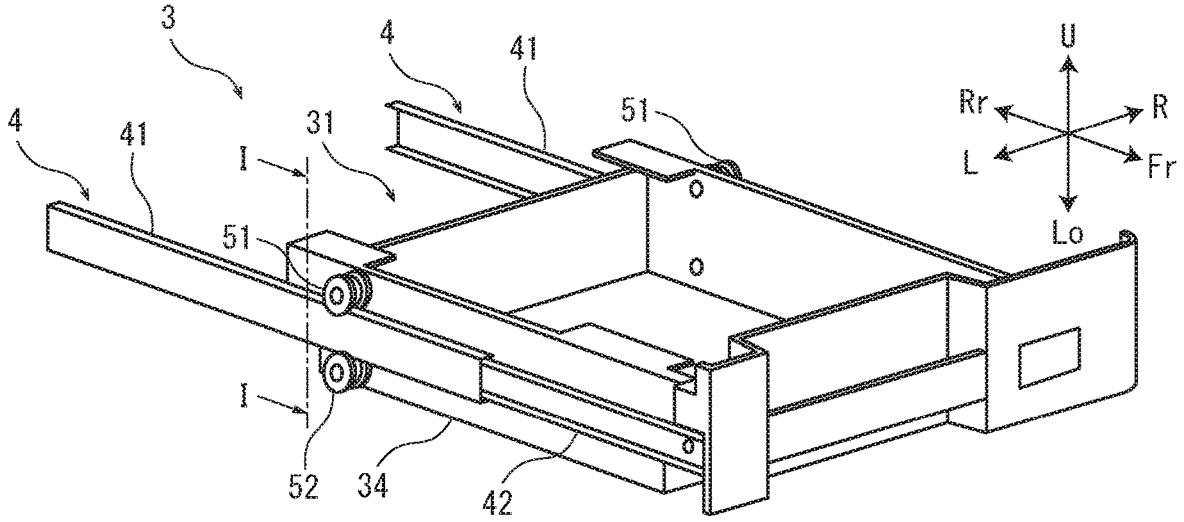
FIG. 3C is a perspective view showing a sheet feeding device according to the embodiment of the present disclosure.
Figure 4:
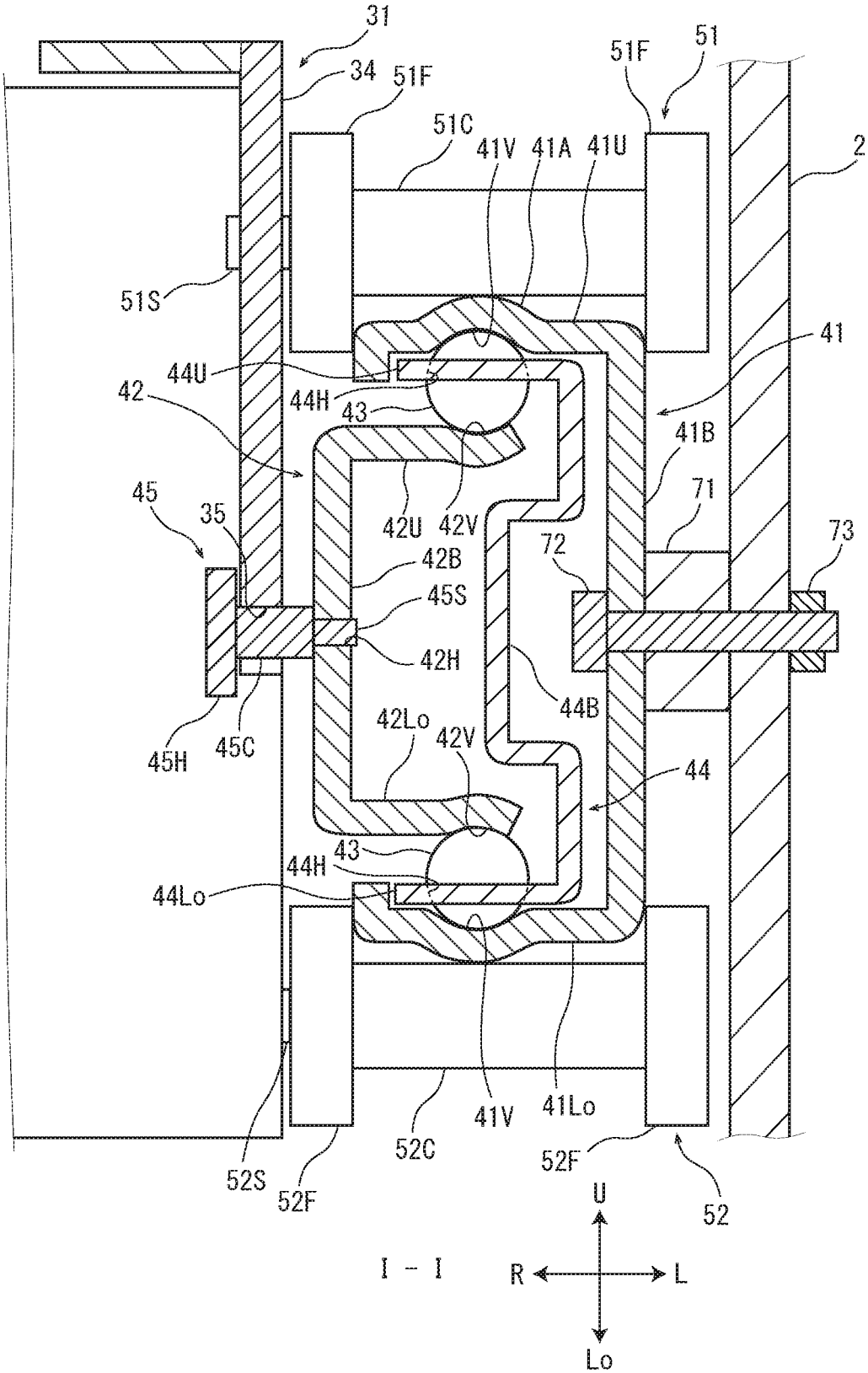
FIG. 4 is a cross sectional view along a I-I line in FIG. 3C.

Next, with reference to FIG. 3A to FIG. 4, a structure of the sheet feeding device 3 will be described. FIG. 3A is a perspective view showing the sheet storage cassette 31. FIG. 3B is a perspective view showing a slide rail 4. FIG. 3C is a perspective view showing the sheet feeding device 3. FIG. 4 is a cross sectional view along a I-I line in FIG. 3C (a face perpendicular to the inserting and drawing direction of the sheet storage cassette (the front-and-rear direction)).

The sheet feeding device 3 includes the sheet storage cassette 31 which is drawable and insertable (detachable and attachable) with respect to the housing along the front-and-rear direction as a first direction, a pair of slide rails 4 facing outer faces of a pair of wall parts 34 of the sheet storage cassette 31, a pair of upper roller members 51 (an example of an upper contact member) provided on the outer faces of the pair of wall parts 34 and a pair of lower roller members 52 (an example of a lower contact member) provided on the outer faces of the pair of wall parts 34. The slide rail 4 includes an outer rail 41 facing the outer face of the wall part 34, an inner rail 42 supported by the outer rail 41 in a slidable manner in the front-and-rear direction, a ball retainer 44 supporting a ball 43 inserted between the outer rail 41 and the inner rail 42 and a positioning pin 45 (an example of a fastening member) fastening the inner rail 42 to the wall part 34 of the sheet storage cassette 31.

As shown in FIG. 3A, the sheet storage cassette 31 is formed in a box-like shape whose upper face is opened. On the front face of the sheet storage cassette 31, a grip 33 is provided for a user to draw and insert the sheet storage cassette 31 with respect to the housing 2. The sheet storage cassette 31 has the pair of wall parts 34 extending along the front-and-rear direction. The walls 34 face the inner walls 2*a* of the cassette storage part when the sheet storage cassette 31 is stored in the cassette storage part of the housing 2. Hereinafter, the front side portion containing the front end portion of each wall part 34 is called a front side area 34Fr, the rear side portion containing the rear end portion of each wall part 34 is called a rear side area 34Rr, and the area between the front side area 34Fr and the rear side area 34Rr is called a center area 34C. The lower end portion of the front side area 34Fr and the lower end portion of the rear side area 34Rr is formed above the lower end portion of the center area 34C. The lower end portion of the front side area 34Fr and the lower end portion of the rear side area 34Rr each has a U-shaped notch 35 opened downward.

As shown in FIG. 3B to FIG. 4, the outer rail 41 is a member whose longitudinal direction is along the front-and-rear direction. The outer rail 41 has a base portion 41B, an upper bent portion 41U and a lower bent portion 41Lo, and is formed in a U-shape with the opened side face in the I-I cross sectional view. The base portion 41B extends in the first direction (the front-and-rear direction), and is mounted to the housing 2 so as to face the outer face of the wall part 34 extending in the first direction of the sheet storage cassette 31. The upper bent portion 41U is bent to a side of the sheet storage cassette 31 from the upper end portion of the base portion 41B. The lower bent portion 41Lo is bent to a side of the sheet storage cassette 31 from the lower end portion of the base portion 41B. The outer rail 41 is fastened to the housing 2 with a bolt 72 and a nut 73 via a spacer 71 to form a gap between the base portion 41B and the housing 2. The outer rail 41 is disposed so as to form gaps between the upper bent portion 41U and the lower bent portion 41Lo, and the housing 2 for inserting a first flange part 51F (described later) of the upper roller member 51 and a second flange part 52F (described later) of the lower roller member 52 respectively. On the lower face of the upper bent portion 41U and the upper face of the lower bent portion 41Lo, concave parts 41V are formed along the front-and-rear direction. The concave part 41V has a curvature corresponding to the surface of the ball 43.

The inner rail 42 is a member whose longitudinal direction is along the front-and-rear direction, and has the same longitudinal length as the outer rail 41. The inner rail 42 is supported by the outer rail 41 in a movable manner along the first direction. The inner rail 42 has a flat plate shaped base portion 42B facing the wall part 34 of the sheet storage cassette 31, an upper bent portion 42U bent to a side of the housing 2 from the upper end portion of the base portion 42B and a lower bent portion 42Lo bent to a side of the housing 2 from the lower end portion of the base portion 42B. On the upper face of the upper bent portion 42U and the lower face of the lower bent portion 42Lo, concave parts 42V are formed along the front-and-rear direction. The concave part 42V has a curvature corresponding to the surface of the ball 43.

The ball retainer 44 is a member whose longitudinal direction is along the front-and-rear direction, and has a longitudinal length shorter than the outer rail 41 and the inner rail 42. The ball retainer 44 has a base portion 44B, an upper holding portion 44U and a lower holding portion 44Lo. The base portion 44B is disposed between the base portion 41B of the outer rail 41 and the inner rail 42. The upper holding portion 44U is bent to a side of the sheet storage cassette 31 from the upper end portion of the base portion 44B, and disposed between the upper bent portion 41U of the outer rail 41 and the upper bent portion 42U of the inner rail 42. The lower holding portion 44Lo is bent to a side of the sheet storage cassette 31 from the lower end portion of the base portion 44B, and disposed between the lower bent portion 41Lo of the outer rail 41 and the lower bent portion 42Lo of the inner rail 42.

The upper holding portion 44U and the lower holding portion 44Lo each has a plurality of ball holes 44H at intervals in the front-and-rear direction. The ball hole 44H has a diameter smaller than a diameter of the ball 43, and is formed such that the surface of the ball 43 is exposed upward and downward from the ball hole 44H. The ball 43 held by the upper holding portion 44U is put between the upper bent portion 41U of the outer rail 41 and the upper bent portion 42U of the inner rail 42. The ball 43 held by the lower holding portion 44Lo is put between the lower bent portion 41Lo of the outer rail 41 and the lower bent portion 42Lo of the inner rail 42. The outer rail 41 supports the inner rail 42 in a slidable manner along the front-and-rear direction via the balls 43 held by the ball retainer 44.

The positioning pin 45 has a shaft portion 45S, a columnar portion 45C having a diameter larger than the shaft portion 45S and a head portion 45H having a diameter larger than the columnar portion 45C. The positioning pins 45 are fastened to screw holes 42H formed near both the end portions of the base portion 42B of the inner rail 42, and are formed so as to protrude from the side face of the inner rail 42 on a side of the sheet storage cassette 31. The positioning pin 45 is engaged with the notch 35 of the sheet storage cassette 31, and the sheet storage cassette 31 is fastened to the inner rail 42.

As shown in FIG. 3A and FIG. 3C, the pair of upper roller members 51 protrudes from the outer faces of the pair of wall parts 34 of the sheet storage cassette 31 in a second direction toward the inside of the housing 2 (a direction orthogonal to the first direction). The upper roller member 51 moves while rotating on the upper face of the upper bent portion 41U of the outer rail 41 when the sheet storage cassette 31 is drawn and inserted with respect to the housing 2. The upper roller member 51 has a first columnar part 51C extending in the second direction and a pair of first flange parts 51F between which the upper bent portion 41U of the outer rail 41 is put in the second direction. The pair of lower roller members 52 protrudes from the outer faces of the pair of wall parts 34 of the sheet storage cassette 31 in the second direction. The lower roller member 52 moves while rotating on the lower face of the lower bent portion 41Lo of the outer rail 41 when the sheet storage cassette 31 is drawn and inserted with respect to the housing 2. The lower roller member 52 has a second columnar part 52C extending in the second direction and a pair of second flange parts 52F between which the lower bent portion 41Lo of the outer rail 41 is put in the second direction. A distance between the left and right first flange parts 51F is slightly larger than a width of the upper bent portion 41U of the outer rail 41 in the left-and-right direction. A distance between the left and right second flange parts 52F is slightly larger than a width of the lower bent portion 41Lo of the outer rail 41 in the left-and-right direction. The upper roller member 51 is disposed above the notch 35 and the lower roller member 52 is disposed below the notch 35.

According to the above described sheet feeding device 3 of the present disclosure, when the sheet storage cassette 31 is drawn and inserted with respect to the housing 2, the upper roller member 51 rolls on the upper face of the upper bent portion 41U (the top part of the convex part 41A) of the outer rail 41 and the lower roller member 52 rolls on the lower face of the lower bent portion 41Lo of the outer rail 41. A load of the sheet storage cassette 31 containing the sheet is mainly transmitted to the outer rail 41 via the upper roller member 51. Then, according to the sheet feeding device 3 of the present embodiment, compared with a case where the upper roller member 51 is not provided, a load transmitted to the inner rail 42 via the positioning pin 45 is decreased so that it becomes possible to restrain a deformation of the inner rail 42. As a result, it becomes possible to restrain an increase of the sliding resistance of the inner rail 42 and to improve a positioning accuracy of the sheet storage cassette 31.

Additionally, according to the sheet feeding device 3 of the present embodiment, the flange parts 51F of the upper roller member 51 restrict a displacement of the sheet storage cassette 31 in the left-and-right direction so that it becomes possible to improve a positioning accuracy of the sheet storage cassette 31 compared with a case where the upper roller member 51 is not provided.

Additionally, according to the sheet feeding device 3 of the present embodiment, the flange parts 52F of the lower roller member 52 restrict the displacement of the sheet storage cassette 31 in the left-and-right direction so that it becomes possible to improve a positioning accuracy of the sheet storage cassette 31 compared with a case where the lower roller member 52 is not provided.

The above embodiment will be modified as follows.

Figure 5:
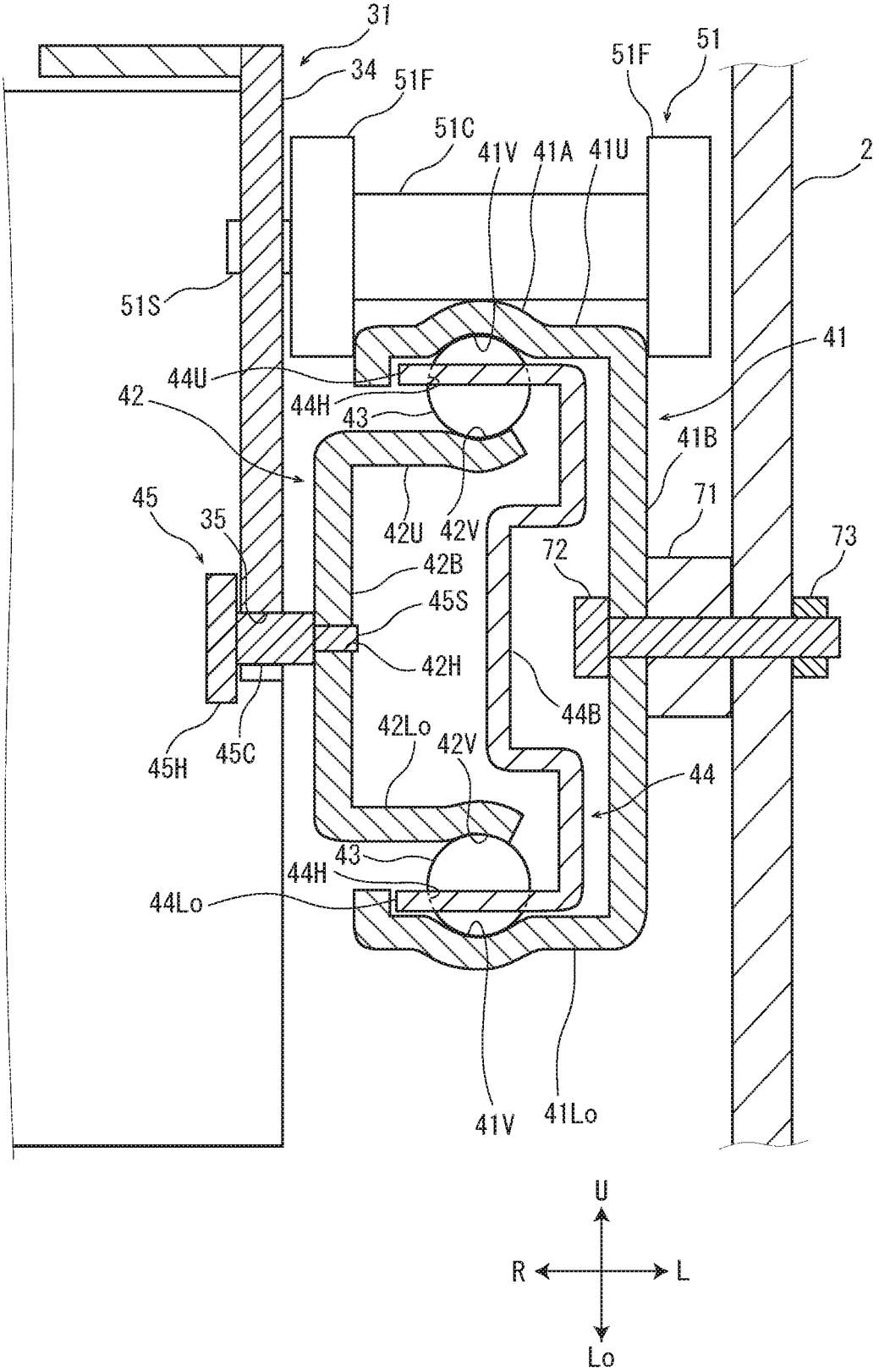
FIG. 5 is a cross sectional view showing the sheet feeding device according to a first modified example of the embodiment of the present disclosure.

As shown in FIG. 5, the sheet storage cassette 31 may not be provided with the lower roller member 52. Also, in this configuration, compared with a case where the upper roller member 51 is not provided, a load transmitted to the inner rail 42 via the positioning pin 45 is decreased so that it becomes possible to restrain a deformation of the inner rail 42.

A plurality of the upper roller members 51 may be provided side by side in the front-and-rear direction on each of the left and right wall parts 34 of the sheet storage cassette 31. In this configuration, compared with the above embodiment, a load transmitted to the inner rail 42 via the positioning pin 45 is decreased so that it becomes possible to restrain a deformation of the inner rail 42.

In place of the upper roller member 51, a sliding member (an example of an upper contact member) slidable on the upper face of the upper bent portion 41U of the outer rail 41 may be provided. For example, the upper roller member 51 may be fixed to a rotational shaft 51S.

In place of the lower roller member 52, a sliding member (an example of a lower contact member) slidable on the lower face of the lower bent portion 41Lo of the outer rail 41 may be provided. For example, the lower roller member 52 may be fixed to a rotational shaft 52S.

Figure 6:
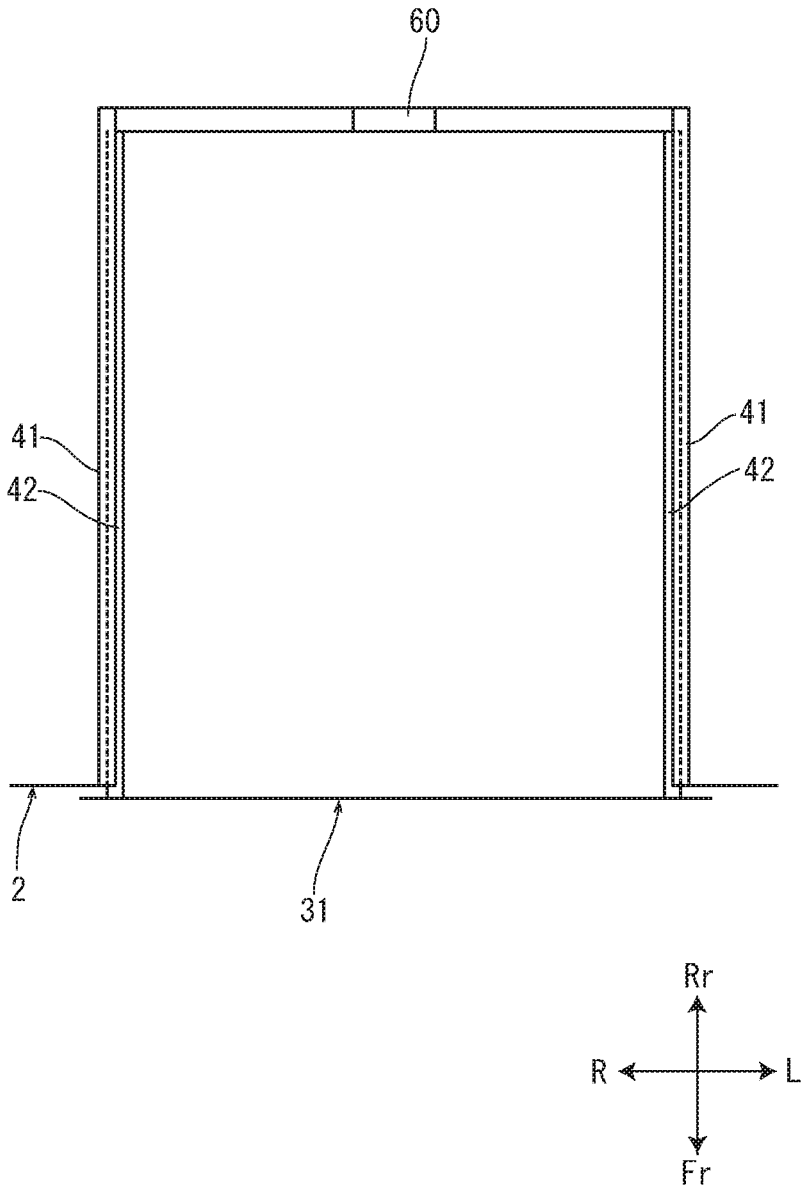
FIG. 6 is a cross sectional view showing the sheet feeding device according to a second modified example of the embodiment of the present disclosure.

The present disclosure may be applied to an image forming apparatus provided with a retracting device 60 (refer to FIG. 6) which automatically retracts the sheet storage cassette 31 into the housing 2. For example, the retracting device 60 is disposed between the rear wall of the sheet storage cassette 31 and the back wall of the cassette storage part. In this case, it becomes possible to attach the sheet storage cassette 31 more surely.

The present disclosure may be applied to a sheet feeding device whose slide rail 4 is not provided with the ball 43 and the ball retainer 44.

The above embodiment, as shown in FIG. 4, shows a case where a convex part 41A having the same shape as the concave part 41V formed on the lower face of the upper bent portion 41U of the outer rail 41 is formed on the upper face of the upper bent portion 41U of the outer rail 41. In this case, a concave part having a shape corresponding to the convex part 41A formed on the upper face of the upper bent portion 41U of the outer rail 41 may be formed on the columnar part 51C of the upper roller member 51 along the circumferential direction. According to the configuration, it becomes possible to roll the upper roller member 51 stably.

The present disclosure may be applied to the sheet feeding device 3 in which the inner rail 42 is fastened to the wall part 34 of the sheet storage cassette 31 by a bolt and a nut (an example of a fastening member) in place of the positioning pin 45.

Although the present disclosure described the specific embodiment, the present disclosure is not limited to the embodiment. It is to be noted that one skilled in the art can modify the embodiment without departing from the scope and spirit of the present disclosure.

The invention claimed is:

1. A sheet feeding device comprising:

a housing having a pair of inner walls facing each other;

a sheet storage cassette attached between the inner walls in an insertable and drawable manner along a first direction, the sheet storage cassette having a pair of wall parts facing the pair of inner walls;

a slide rail including an outer rail and an inner rail, the outer rail extending along the first direction on each of the inner walls and the inner rail extending along the first direction on the wall part, the inner rail being supported by the outer rail in a movable manner;

an upper contact member provided on each of the wall parts and moving on an upper face of the outer rail when the sheet storage cassette is inserted and drawn with respect to the housing; and a lower contact member provided on each of the wall parts and moving on a lower face of the outer rail when the sheet storage cassette is inserted and drawn with respect to the housing, wherein the upper contact member and the lower contact member are disposed so as to line up in an upper-and-lower direction, the outer rail has a base portion mounted to the housing so as to face an outer face of the wall part, an upper bent portion bent to a side of the sheet storage cassette from an upper end portion of the base portion and a lower bent portion bent to a side of the sheet storage cassette from a lower end portion of the base portion, and the upper contact member moves in contact with the upper bent portion.

2. A sheet feeding device comprising:

a housing having a pair of inner walls facing each other;

a sheet storage cassette attached between the inner walls in an insertable and drawable manner along a first direction, the sheet storage cassette having a pair of wall parts facing the pair of inner walls;

a slide rail including an outer rail and an inner rail, the outer rail extending along the first direction on each of the inner walls and the inner rail extending along the first direction on the wall part, the inner rail being supported by the outer rail in a movable manner; and an upper contact member provided on each of the wall parts and moving on an upper face of the outer rail when the sheet storage cassette is inserted and drawn with respect to the housing, wherein the upper contact member is composed of a roller member supported by each of the wall parts of the sheet storage cassette in a rotatable manner, and the roller member includes a first columnar part extending in a second direction orthogonal to the first direction and a pair of first flange parts which sandwich the upper face of the outer rail in the second direction.

3. The sheet feeding device according to claim 2, wherein the upper face of the outer rail has a convex part protruding upward and extending along the first direction, and the first columnar part moves in contact with a top part of the convex part.

4. The sheet feeding device according to claim 2, wherein the upper contact member is protruded on an upstream side end portion of each of the wall parts in a drawing direction of the sheet storage cassette from the housing.

5. An image forming apparatus comprising:

the sheet feeding device according to claim 2; and an image forming portion which forms a toner image on a sheet fed from the sheet feeding device.

6. The image forming apparatus according to claim 5, comprising a retracting device which retracts the sheet storage cassette into the housing.

7. A sheet feeding device comprising:

a housing having a pair of inner walls facing each other;

a sheet storage cassette attached between the inner walls in an insertable and drawable manner along a first direction, the sheet storage cassette having a pair of wall parts facing the pair of inner walls;

a slide rail including an outer rail and an inner rail, the outer rail extending along the first direction on each of the inner walls and the inner rail extending along the first direction on the wall part, the inner rail being supported by the outer rail in a movable manner;

an upper contact member provided on each of the wall parts and moving on an upper face of the outer rail when the sheet storage cassette is inserted and drawn with respect to the housing; and a plurality of fastening members fastening end portions in the first direction of the inner rail to each of the wall parts of the sheet storage cassette, wherein the upper contact member is disposed between the plurality of fastening members.

* * * * *